US010904978B1

(12) United States Patent
Wang

(10) Patent No.: US 10,904,978 B1
(45) Date of Patent: Jan. 26, 2021

(54) TWO-WIRE CODE CONTROLLED SYNCHRONOUS LED STRIPE AND A CONTROL METHOD THEREOF

(71) Applicant: NINGBO HUBBLE LIGHTING TECHNOLOGY CO., LTD., Yuyao (CN)

(72) Inventor: Yi Wang, Yuyao (CN)

(73) Assignee: NINGBO HUBBLE LIGHTING TECHNOLOGY CO., LTD., Yuyao (CN)

( * ) Notice: Subject to any disclaimer, the term of this patent is extended or adjusted under 35 U.S.C. 154(b) by 0 days.

(21) Appl. No.: 16/661,216

(22) Filed: Oct. 23, 2019

(30) Foreign Application Priority Data

Jul. 30, 2019 (CN) ..... 2019 1 0695546
Jul. 30, 2019 (CN) ..... 2019 2 1212895 U

(51) Int. Cl.
*H05B 45/20* (2020.01)
*H05B 45/48* (2020.01)
*H05B 47/185* (2020.01)

(52) U.S. Cl.
CPC ..... *H05B 45/48* (2020.01); *H05B 45/20* (2020.01); *H05B 47/185* (2020.01)

(58) Field of Classification Search
CPC ..... H05B 45/20; H05B 45/48; H05B 47/185
See application file for complete search history.

(56) References Cited

U.S. PATENT DOCUMENTS 8,052,303 B2 * 11/2011 Lo ..... F21V 31/04 362/249.05
2014/0203710 A1 * 7/2014 Li ..... H05B 47/10 315/129
2017/0141516 A1 * 5/2017 Chen ..... H01R 4/185
2018/0113547 A1 * 4/2018 Miyake ..... G06F 3/044

* cited by examiner

*Primary Examiner* — Henry Luong
(74) *Attorney, Agent, or Firm* — Charles C. Achkar; Ostrolenk Faber LLP.

(57) ABSTRACT

The present invention discloses a two-wire code controlled synchronous light-emitting diode (LED) strip, which comprises a controller and a plurality of RGBW-LED modules, wherein one input end of said controller is connected to a pushbutton and the other input end is connected to the receiving head of a remote controller, each RGBW-LED is connected in parallel to the voltage output end of the controller with two wires, and the output end of the controller generates a power-off signal according to the signal sent from said pushbutton and the signal sent from the receiving head of said remote controller so as to control each RGBW-LED to work according to the power-off signal. The present invention further relates to a control method of the two-wire code controlled synchronous LED strip, which can accurately determine the LED strip mode and can save the communication time.

3 Claims, 6 Drawing Sheets

TWO-WIRE CODE CONTROLLED SYNCHRONOUS LED STRIPE AND A CONTROL METHOD THEREOF

CROSS REFERENCE TO RELATED APPLICATIONS

The present application claims priority to China Application No. 201910695546.6 filed Jul. 30, 2019 and China Application No. 201921212895.X filed Jul. 30, 2019, the subject matter of each of which are incorporated herein by reference in their entirety.

TECHNICAL FIELD

The present invention relates to the technical field of an LED, and in particular to a two-wire code controlled synchronous LED strip and a control method thereof.

BACKGROUND ART

Since RGBW-LED strips can change colors to create an atmosphere, they are often used to decorate party places.

Currently, a RGBW-LED strip on the market comprises a power supply box, a controller, a LED strip and LED holders, wherein 4 wires are required to control 4 colors and at least 5 wires are required to control an RGBW-LED in consideration of a common negative pole. If an LED-strip has 24 LED holders, 120 nodes are required to control the color change of the LEDs. In this way, the cost of the wires of an LED strip is high, cabling is very complicated, and wires are likely connected incorrectly during the production of the LED strip.

SUMMARY OF THE INVENTION

To overcome the shortcomings in the prior art, the present invention provides an LED strip which can be controlled with only 2 wires, as well as a control method of the LED strip.

To achieve the above-mentioned objective, the following technical solution is adopted in the present invention:

A two-wire code controlled synchronous LED strip comprises a controller and a plurality of RGBW-LED modules, wherein one input end of said controller is connected to a pushbutton and the other input end is connected to the receiving head of the remote controller, each RGBW-LED is connected in parallel to the voltage output end of the controller with two wires, and the output end of the controller generates a power-off signal according to the signal sent from said pushbutton and the signal sent from the receiving head of said remote controller so as to control each RGBW-LED to work according to the power-off signal.

Further, said controller comprises a first single-chip microcomputer, a first switch transistor and a second switch transistor, one output pin of said single-chip microcomputer controls the control end of the first switch transistor, said first switch transistor controls the opening and closing of the second switch transistor, and said second switch transistor controls the voltage output from the output end of the controller.

Further, said RGBW-LED module comprises a positive-pole pin, a negative-pole pin, a second single-chip microcomputer and an RGBW-LED, said RGBW-LED comprises a red LED, a green LED, a blue LED and a white LED, and the four output pins of said second single-chip microcomputer respectively control the red LED, green LED, blue LED and white LED of said RGBW-LED.

Further, said power-off signal contains number of power-offs and power-off duration.

Further, said two-wire code controlled synchronous LED strip further comprises a voltage dropping device, the input end of said voltage dropping device is connected to the mains and the output end is connected to the power end of said controller.

A control method of the two-wire code controlled synchronous LED strip is provided, wherein the controller receives a signal sent from the pushbutton or from the receiving head of the remote controller, the first single-chip microcomputer of the controller determines the LED strip mode and controls the output pins of the controller to generate a power-off signal, the second single-chip microcomputer of the RGBW-LED module reads the power-off signal and determines the LED strip mode, and the output pins of the second single-chip microcomputer control the red LED, green LED, blue LED and white LED of the RGBW-LED.

Further, when the controller receives a signal from the pushbutton, the first single-chip microcomputer of the controller reads the pushbutton pressing signal duration and makes a determination: if the pushbutton pressing signal duration is less than the minimum pushbutton press and hold duration, the first single-chip microcomputer of the controller reads the original LED strip mode and adds 1 to the original LED strip mode to form a new LED strip mode; if the pushbutton pressing signal duration is greater than the minimum pushbutton press and hold duration, the first single-chip microcomputer of the controller determines that a new LED strip mode is obtained according to the pushbutton pressing signal duration, and the first single-chip microcomputer further determines the new LED strip mode; if the new LED strip mode is less than the maximum power-offs LED strip mode, the first single-chip microcomputer controls the controller to output a power-off signal in which the number of power-offs corresponds to the new LED strip mode, and the power-off duration is less than the minimum power-off duration, with the interval between every two power-off signals being less than the maximum interval; if the new LED strip mode is greater than the maximum power-offs LED strip mode, the controller generates a power-off signal with the corresponding power-off duration according to the new LED strip mode.

Further, when the controller receives a signal from the receiving head of the remote controller, the first single-chip microcomputer of the controller obtains a new LED strip mode and determines if the new LED strip mode is less than the maximum power-offs LED strip mode, and if so, the controller generates a power-off signal in which the number of power-offs corresponds to the new LED strip mode, and the power-off duration is less than the minimum power-off duration, with the interval between every two power-off signals being less than the maximum interval; if the new LED strip mode is greater than the maximum power-offs LED strip mode, the controller generates a power-off signal with the corresponding power-off duration according to the LED strip mode.

Further, after receiving a power-off signal, the second single-chip microcomputer of said RGBW-LED module first reads the power-off duration in the power-off signal and determines if the power-off duration in the power-off signal is less than the minimum power-off duration, and if so, the second single-chip microcomputer counts the power-off signal, with the interval between the power-off durations before and after counting being less than the maximum interval; if no power-off signal is generated within the maximum interval, the second single-chip microcomputer ends counting and determines the new LED strip mode according to the count; if the power-off duration in the power-off signal is greater than the minimum power-off duration, the second single-chip microcomputer makes a determination according to the power-off duration and reads the new LED strip mode, and the output pins of the second single-chip microcomputer control the red LED, green LED, blue LED and white LED of the RGBW-LED according to the new LED strip mode.

Compared with the prior art, the present invention has the following advantageous effects:

(1) The structure is simple, and a two-wire control is adopted, reducing the production cost and the risks of incorrect wire connections during production.

(2) When many modes are involved, power-off duration is used as a control signal for switching to a subsequent mode, reducing the error rate of signal transmission and attaining more effective communication resources.

DETAILED DESCRIPTION OF THE UTILITY MODEL

The following further describes the present invention in combination with the drawings and embodiments. The following embodiments are used to describe the present invention, but not to restrict the scope of the present invention.

Figure 1:
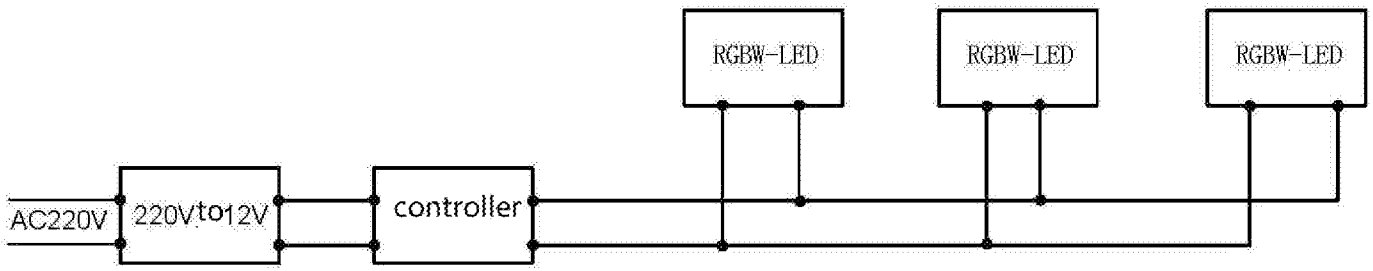
FIG. 1 is a schematic diagram of the circuit of the two-wire code controlled synchronous LED strip of the present invention.
Figure 2:
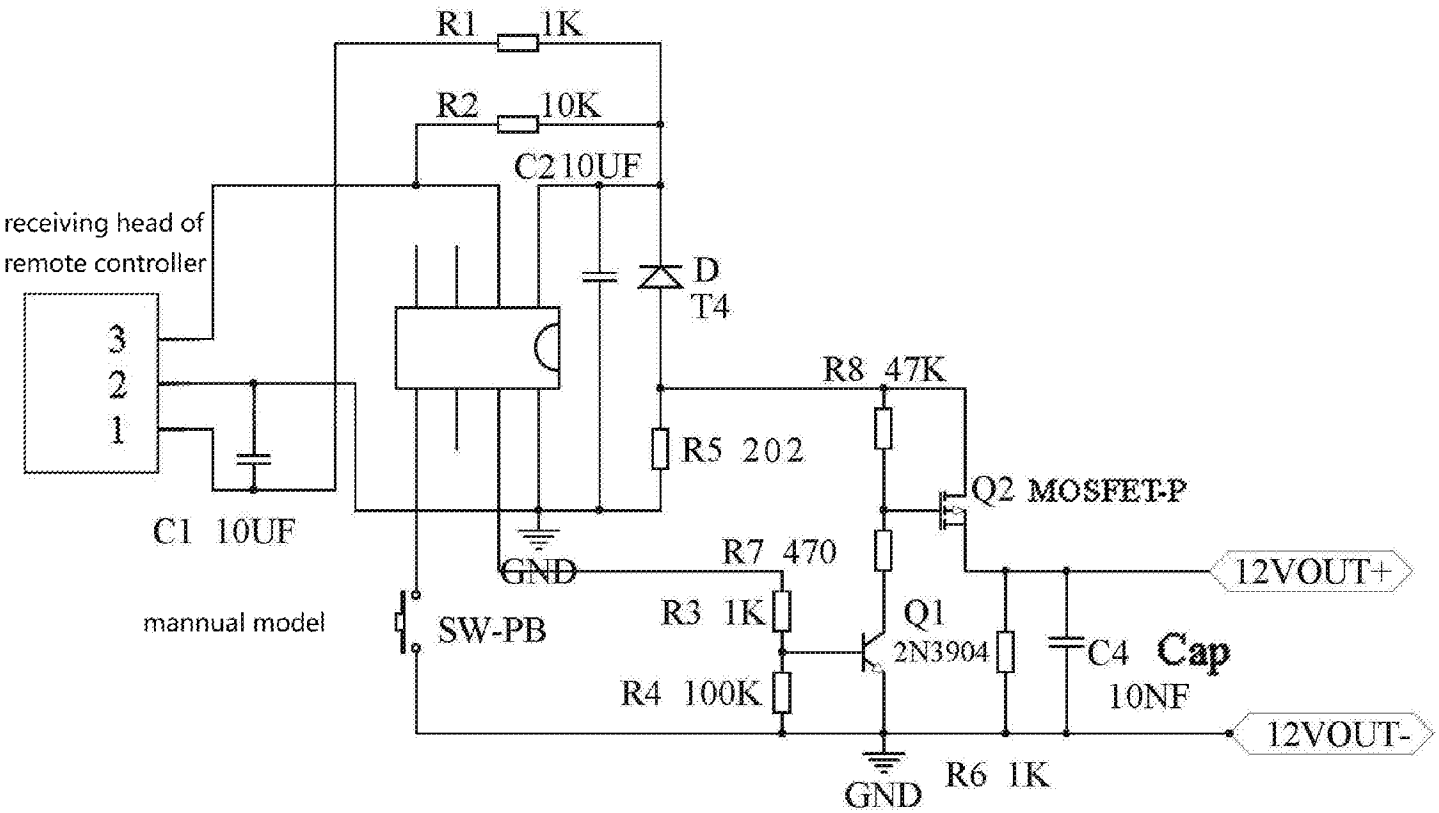
FIG. 2 is a schematic diagram of the controller of the two-wire code controlled synchronous LED strip of the present invention.
Figure 3:
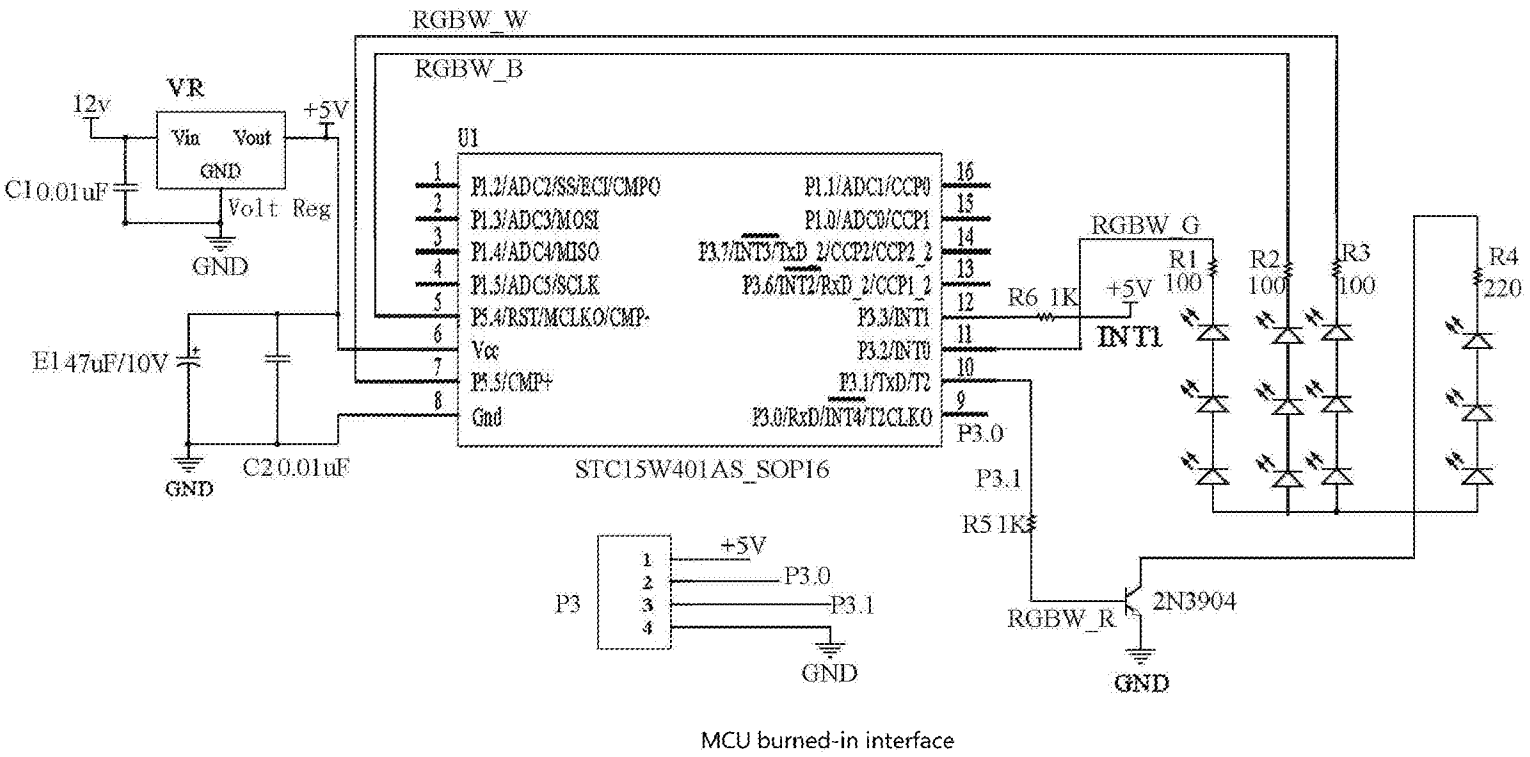
FIG. 3 is a schematic diagram of a RGBW-LED module of the two-wire code controlled synchronous LED strip of the present invention.
Figure 4:
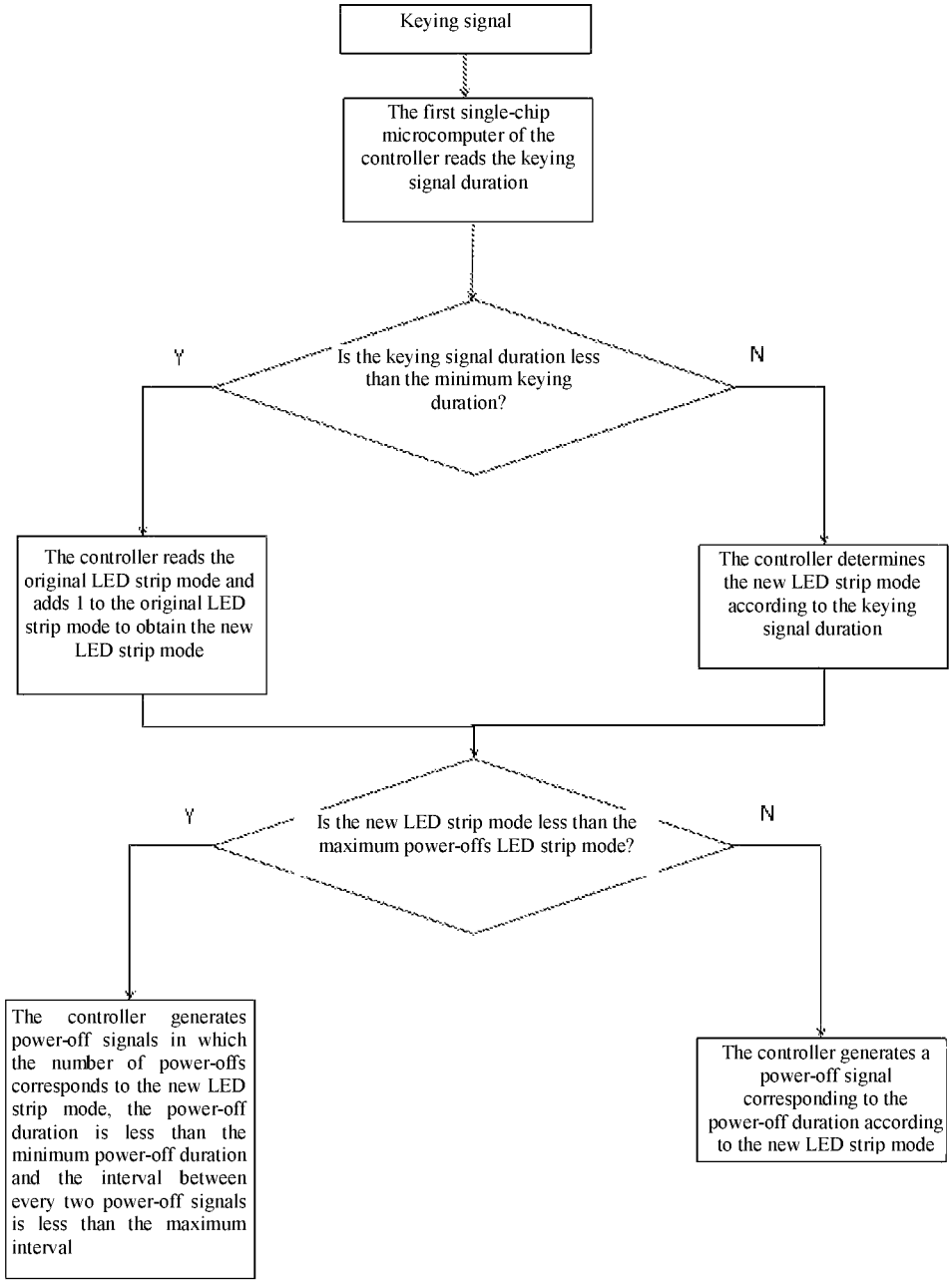
FIG. 4 is a flowchart of the control of the controller in pushbutton mode in the control method of the two-wire code controlled synchronous LED strip of the present invention.
Figure 5:
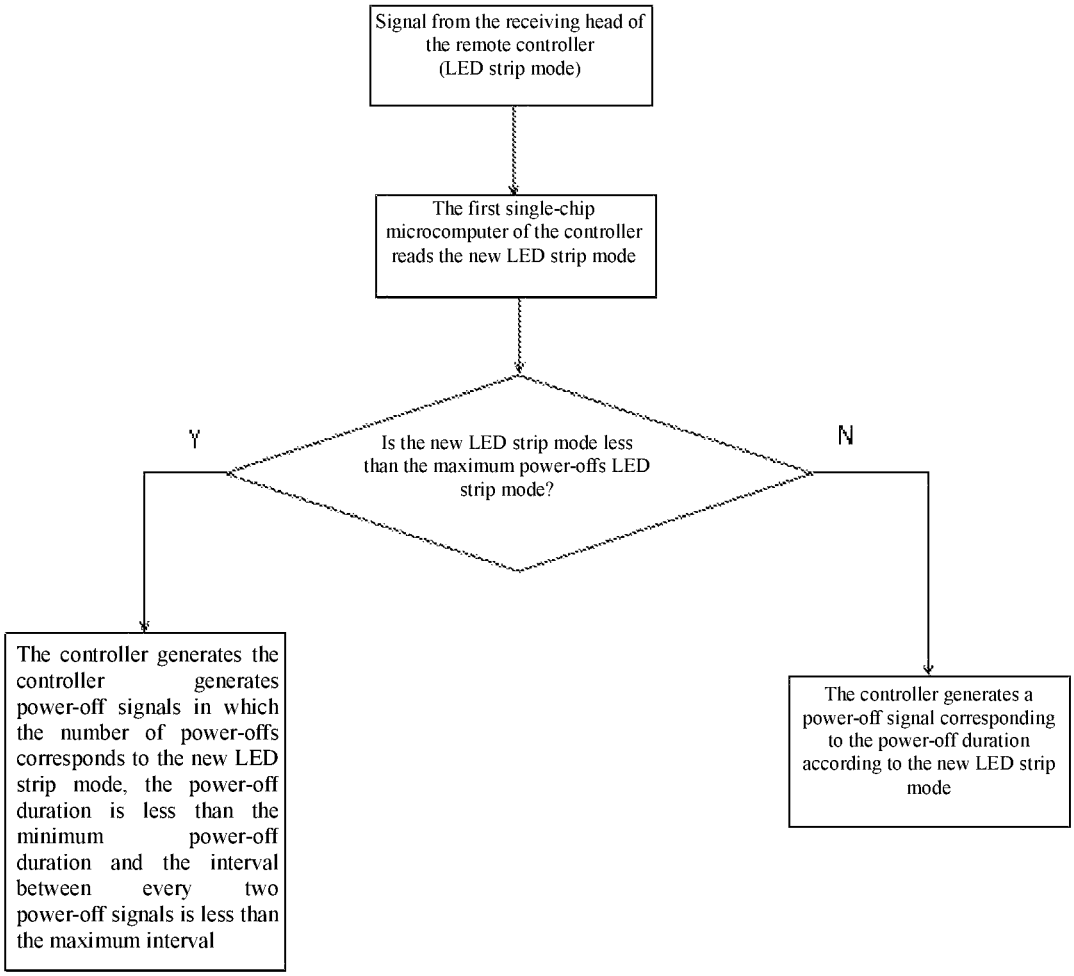
FIG. 5 is a flowchart of the control of the controller in remote control mode in the control method of the two-wire code controlled synchronous LED strip of the present invention.
Figure 6:
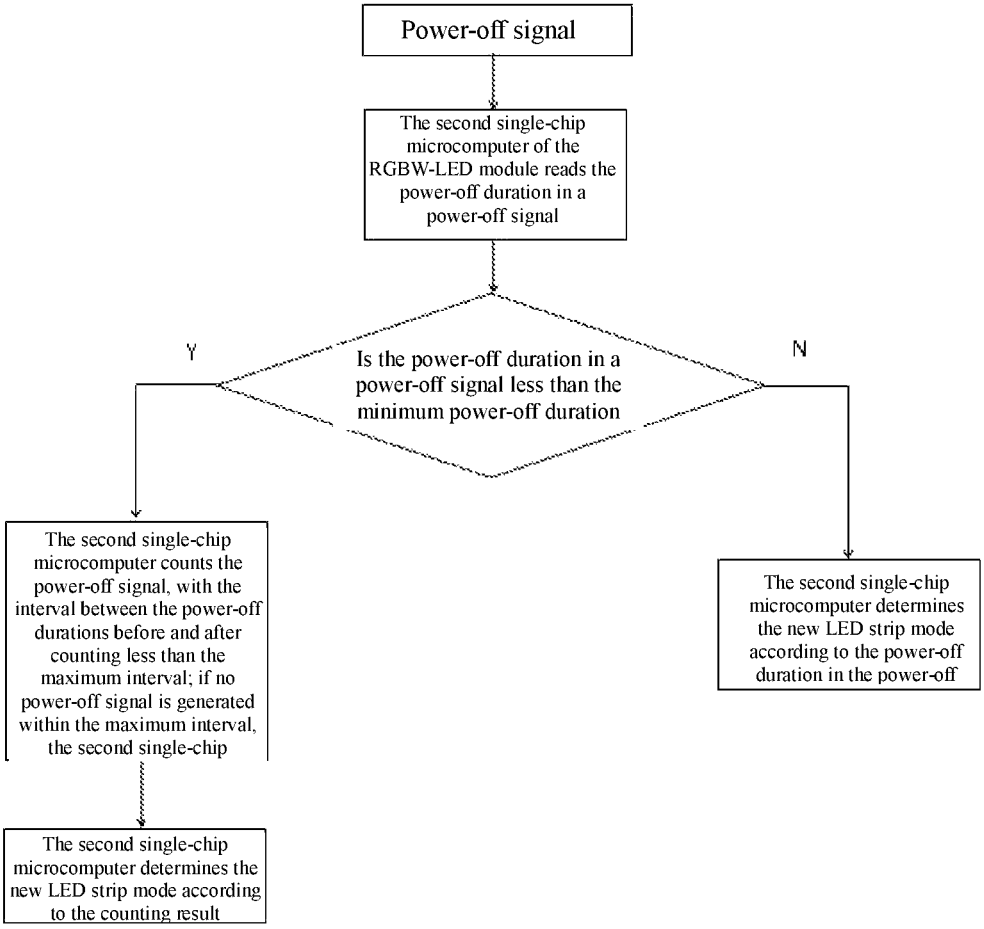
FIG. 6 is a flowchart of the control of an RGBW-LED module in the control method of the two-wire code controlled synchronous LED strip of the present invention.

As shown in FIGS. 1, 2, and 3, a two-wire code controlled synchronous LED strip comprises a controller and a plurality of RGBW-LED modules, wherein one input end of said controller is connected to a pushbutton and the other input end is connected to the receiving head of a remote controller, each RGBW-LED is connected in parallel to the voltage output end of the controller with two wires, and the output end of the controller generates a power-off signal according to the signal sent from said pushbutton and the signal sent from the receiving head of said remote controller so as to control each RGBW-LED to work according to the power-off signal.

Preferably, said controller comprises a first single-chip microcomputer, a first switch transistor and a second switch transistor, one output pin of said single-chip microcomputer controls the control end of the first switch transistor, said first switch transistor controls the opening and closing of the second switch transistor, and said second switch transistor controls the voltage output from the output end of the controller.

Preferably, said RGBW-LED module comprises a positive-pole pin, a negative-pole pin, a second single-chip microcomputer and an RGBW-LED, said RGBW-LED comprises a red LED, a green LED, a blue LED and a white LED, and the four output pins of said second single-chip microcomputer respectively control the red LED, green LED, blue LED and white LED of said RGBW-LED.

Preferably, said power-off signal contains number of power-offs and power-off duration.

Preferably, said two-wire code controlled synchronous LED strip further comprises a voltage dropping device, the input end of said voltage dropping device is connected to the mains and the output end is connected to the power end of said controller.

A control method of the two-wire code controlled synchronous LED strip is provided, wherein the controller receives a signal sent from the pushbutton or from the receiving head of the remote controller, the first single-chip microcomputer of the controller determines the LED strip mode and controls the generation of a power-off signal from the output pins of the controller, the second single-chip microcomputer of the RGBW-LED module reads the power-off signal and determines the LED strip mode, and the output pins of the second single-chip microcomputer control the red LED, green LED, blue LED and white LED of the RGBW-LED.

Preferably, when the controller receives a signal from the pushbutton, the first single-chip microcomputer of the controller reads the pushbutton pressing signal duration and determines if the pushbutton pressing signal duration is less than the minimum pushbutton press and hold duration, and if so, the first single-chip microcomputer of the controller reads the original LED strip mode and adds 1 to the original LED strip mode to form a new LED strip mode; if the pushbutton pressing signal duration is greater than the minimum pushbutton press and hold duration, the first single-chip microcomputer of the controller makes a determination according to the pushbutton pressing signal duration to obtain a new LED strip mode and the first single-chip microcomputer further determines the new LED strip mode; if the new LED strip mode is less than the maximum power-offs LED strip mode, the first single-chip microcomputer controls the controller to output a power-off signal in which the number of power-offs corresponds to the new LED strip mode, and the power-off duration is less than the minimum power-off duration, with the interval between every two power-off signals being less than the maximum interval; if the new LED strip mode is greater than the maximum power-offs LED strip mode, the controller generates a power-off signal with the corresponding power-off duration according to the new LED strip mode.

Preferably, when the controller receives a signal from the receiving head of the remote controller, the first single-chip microcomputer of the controller obtains a new LED strip mode and determines if the new LED strip mode is less than the maximum power-offs LED strip mode, and if so, the controller generates a power-off signal in which the number of power-offs corresponds to the new LED strip mode, and the power-off duration is less than the minimum power-off duration, with the interval between every two power-off signals being less than the maximum interval; if the new LED strip mode is greater than the maximum power-offs LED strip mode, the controller generates a power-off signal with the corresponding power-off duration according to the LED strip mode.

Preferably, after receiving a power-off signal, the second single-chip microcomputer of said RGBW-LED module first reads the power-off duration in the power-off signal and determines if the power-off duration in the power-off signal is less than the minimum power-off duration, and if so, the second single-chip microcomputer counts the power-off signal, with the interval between the power-off durations before and after counting being less than the maximum interval; if no power-off signal is generated within the maximum interval, the second single-chip microcomputer ends counting and determines the new LED strip mode according to the count; if the power-off duration in the power-off signal is greater than the minimum power-off duration, the second single-chip microcomputer makes a determination according to the power-off duration and reads the new LED strip mode, and the output pins of the second single-chip microcomputer control the red LED, green LED, blue LED and white LED of the RGBW-LED according to the new LED strip mode.

The minimum pushbutton press and hold duration is set to 2 seconds, the maximum power-offs LED strip mode is set to mode 5, the minimum power-off duration is set to 1 second, and the maximum interval is set to 2 seconds.

In pushbutton mode, the pushbutton is pressed. If the pushbutton pressing signal duration is 1, which is less than the minimum pushbutton press and hold duration, the controllers adds 1 to the existing mode to obtain a new mode. If the obtained mode is mode 3, which is less than the maximum power-offs LED strip mode, the controller generates 3 power-off signals. The duration of each power-off signal is 0.5 seconds, which is less than the minimum power-off duration, and the interval between two power-off signals is 1 second, which is less than the maximum interval. The RGBW-LED module receives the signals, reads the duration of the power-off signals, which is 0.5 seconds and is less than the minimum power-off duration, and starts counting. After the count reaches 3, and no power-off signal is generated in the maximum interval of 2 seconds, the RGBW-LED module ends counting and determines the mode to be mode 3. If the obtained mode is mode 6, which is greater than the maximum power-offs LED strip mode, the controller generates a power-off signal with a duration of 6 seconds, and the RGBW-LED receives the signal, reads the duration of the power-off signal, which is 6 seconds and is greater than the minimum power-off duration, and determines that the new mode is mode 6 according to the duration of the power-off signal.

If the pushbutton pressing signal duration is 3 seconds, which is greater than the minimum pushbutton press and hold duration, the controller determines according to the pushbutton pressing signal duration that the new mode is mode 3, which is less than the maximum power-off LED strip mode, and the controller generates 3 power-off signals. The duration of each power-off signal is 0.5 seconds, which is less than the minimum power-off duration, and the interval between two power-off signals is 1 second, which is less than the maximum interval. The RGBW-LED module receives the signals, reads the duration of the power-off signals, which is 0.5 seconds and is less than the minimum power-off duration, and starts counting. After the count reaches 3, and no power-off signal is generated in the maximum interval of 2 seconds, the RGBW-LED module ends counting and determines the mode to be mode 3. If the pushbutton pressing signal duration is 6 seconds, which is greater than the minimum pushbutton press and hold duration, the controller determines that the new mode is mode 6 according to the pushbutton pressing signal duration, which is greater than the maximum power-offs LED strip mode, the controller generates a power-off signal with a duration of 6 seconds, and the RGBW-LED receives the signal, reads the duration of the power-off signal, which is 6 seconds and is greater than the minimum power-off duration, and determines that the new mode is mode 6 according to the duration of the power-off signal.

In the remote-control mode, the controller receives a signal (LED strip mode signal) and obtains the new LED strip mode. If the new mode is mode 3, which is less than the maximum power-offs LED strip mode, the controller generates 3 power-off signals. The duration of each power-off signal is 0.5 seconds, which is less than the minimum power-off duration, and the interval between two power-off signals is 1 second, which is less than the maximum interval. The RGBW-LED module receives the signals, reads the duration of the power-off signals, which is 0.5 seconds and is less than the minimum power-off duration, and starts counting. After the count reaches 3, and no power-off signal is generated in the maximum interval of 2 seconds, the RGBW-LED module ends counting and determines the mode to be mode 3. If the new mode is mode 6, which is greater than the maximum power-offs LED strip mode, the controller generates a power-off signal with a duration of 6 seconds, and the RGBW-LED receives the signal, reads the duration of the power-off signal, which is 6 seconds and is greater than the minimum power-off duration, and determines that the new mode is mode 6 according to the duration of the power-off signal.

The data above is only used to explain the present invention more clearly, and the actual data is designed according to the precision and sensitivity of hardware.

When the LED strip mode is greater than the maximum power-offs LED strip mode, if power-off duration is used as a communication signal, the following benefits can be achieved: (1) the communication time can be saved when many modes are involved; (2) if a number of power-offs is used as a communication signal when many modes are involved in mode switching, the chip reading the signal cannot react sensitively, resulting in an incorrect mode determination.

Only preferred embodiments of the present invention are described above. It should be noted that those skilled in the art can make improvements and modifications without departing from the principle of the present invention and these improvements and modifications should also fall within the scope of protection of the present invention.

What is claimed is:

1. A control method of a two-wire code controlled synchronous LED strip, wherein a controller receives a signal sent from a pushbutton or a receiving head of a remote controller, a first single-chip microcomputer of the controller determines a LED strip mode and controls output pins of the controller to generate a corresponding power-off signal, a second single-chip microcomputer of a RGBW-LED module reads the corresponding power-off signal and determines the LED strip mode, and output pins of the second single-chip microcomputer control a red LED, green LED, blue LED and white LED of the LED strip, wherein when the controller receives the signal from the pushbutton, the first single-chip microcomputer of the controller reads a pushbutton pressing signal duration and determines if the pushbutton pressing signal duration is less than a minimum pushbutton press and hold duration, and if so, the first single-chip microcomputer of the controller reads an original LED strip mode and adds 1 to the original LED strip mode to form a new LED strip mode; if the pushbutton pressing signal duration is greater than the minimum pushbutton press and hold duration, the first single-chip microcomputer of the controller determines that the new LED strip mode is obtained according to the pushbutton pressing signal duration and the first single-chip microcomputer further determines if the new LED strip mode is less than a maximum power-offs LED strip mode; if the first single-chip microcomputer controls the controller to output the corresponding power-off signal in which a number of power-offs corresponds to the new LED strip mode and a power-off duration is less than a minimum power-off duration, with an interval between every two power-off signals being less than a maximum interval; if the new LED strip mode is greater than the maximum power-offs LED strip mode, the controller generates the corresponding power-off signal with a corresponding power-off duration according to the new LED strip mode.

2. A control method of a two-wire code controlled synchronous LED strip, wherein a controller receives a signal sent from a pushbutton or a receiving head of a remote controller, a first single-chip microcomputer of the controller determines a LED strip mode and controls output pins of the controller to generate a corresponding power-off signal, a second single-chip microcomputer of a RGBW-LED module reads the corresponding power-off signal and determines the LED strip mode, and output pins of the second single-chip microcomputer control a red LED, green LED, blue LED and white LED of the LED strip, wherein when the controller receives the signal from the receiving head of the remote controller, the first single-chip microcomputer of the controller obtains a new LED strip mode and determines if the new LED strip mode is less than a maximum power-offs LED strip mode, and if so, the controller generates a power-off signal in which a number of power-offs corresponds to the new LED strip mode, and a power-off duration is less than a minimum power-off duration, with a interval between every two power-off signals being less than a maximum interval; if the new LED strip mode is greater than the maximum power-offs LED strip mode, the controller generates a power-off signal with a corresponding power-off duration according to the new LED strip mode.

3. A control method of a two-wire code controlled synchronous LED strip, wherein a controller receives a signal sent from a pushbutton or a receiving head of a remote controller, a first single-chip microcomputer of the controller determines a LED strip mode and controls output pins of the controller to generate a corresponding power-off signal, a second single-chip microcomputer of a RGBW-LED module reads the corresponding power-off signal and determines the LED strip mode, and output pins of the second single-chip microcomputer control a red LED, green LED, blue LED and white LED of the LED strip, wherein upon receiving the corresponding power-off signal, the second single-chip microcomputer of said RGBW-LED module first reads a power-off duration in the corresponding power-off signal and determines if the power-off duration in the corresponding power-off signal is less than a minimum power-off duration, and if so, the second single-chip microcomputer counts the corresponding power-off signal, with an interval between the power-off durations before and after counting being less than the maximum interval; if no power-off signal is generated within a maximum interval, the second single-chip microcomputer ends counting and determines a new LED strip mode according to the count; if the power-off duration in the corresponding power-off signal is greater than the minimum power-off duration, the second single-chip microcomputer makes a determination according to the power-off duration and reads the new LED strip mode, and the output pins of the second single-chip microcomputer control the red LED, green LED, blue LED and white LED according to the new LED strip mode.

* * * * *